US007661396B2

(12) United States Patent
Sakita

(10) Patent No.: US 7,661,396 B2
(45) Date of Patent: Feb. 16, 2010

(54) ACTUATION SUBSYSTEM OF VARIABLE COMPRESSION RATIO CONTROL SYSTEM FOR INTERNAL COMBUSTION ENGINE

(76) Inventor: Masami Sakita, P.O. Box 61089, Palo Alto, CA (US) 94306-1089

( * ) Notice: Subject to any disclaimer, the term of this patent is extended or adjusted under 35 U.S.C. 154(b) by 138 days.

(21) Appl. No.: 11/999,903

(22) Filed: Dec. 8, 2007

(65) Prior Publication Data

US 2009/0145715 A1 Jun. 11, 2009

(51) Int. Cl.
*F02D 15/02* (2006.01)
*F02B 75/04* (2006.01)

(52) U.S. Cl. ..... 123/48 B; 123/78 F; 123/197.5

(58) Field of Classification Search ..... 123/48 B, 123/48 C, 78 E, 78 F, 197.4, 198 P, 197.5
See application file for complete search history.

(56) References Cited

U.S. PATENT DOCUMENTS 5,031,715 A * 7/1991 Ogawa et al. ..... 180/179
6,202,623 B1 3/2001 Ehrlich
6,247,430 B1 6/2001 Yapici
6,588,384 B2 7/2003 Yapici
7,007,640 B2 3/2006 Sakita
7,059,280 B2 6/2006 Nohara et al.
7,174,865 B2 2/2007 Sakita

* cited by examiner

*Primary Examiner*—Hai H Huynh

(57) ABSTRACT

The VCR actuation subsystem includes a drive mechanism, a connecting mechanism, and an actuator mechanism. The drive mechanism includes generally identical first and second clutch assemblies. The clutch assembly includes a clutch driver plate assembly mounted on the power shaft of an engine, and a clutch driven plate assembly rotatably and longitudinally slidably mounted in a groove on the power shaft. The clutch driven plate assembly includes a pulley tire longitudinally slidably mounted on its outer wall and a spring that holds the clutch driven plate assembly away from the paired clutch driver plate assembly and pushes the clutch driven plate assembly against the other clutch driven plate assembly when the drive mechanism is not activated. The connecting mechanism includes a pair of pulleys mounted on a drive gear shaft that rotatably connects the power shaft and the actuator mechanism.

25 Claims, 9 Drawing Sheets

ACTUATION SUBSYSTEM OF VARIABLE COMPRESSION RATIO CONTROL SYSTEM FOR INTERNAL COMBUSTION ENGINE

FIELD OF THE INVENTION

This invention relates generally to an actuation subsystem of variable compression ratio control system for internal combustion engines, and more particularly to such a system that uses mechanical actuators.

BACKGROUND OF THE INVENTION

It is generally believed that the engine equipped with a variable compression ratio (VCR) control system should work best if operated with a lower compression ratio under higher load conditions, and with a higher compression ratio under relatively lower load conditions. The higher load conditions occur, for example, at the start from a stopped state, during climbing on a hill and during an overtaking maneuver, and the relatively lower load conditions occur, for example, during cruising on a highway.

The VCR control system should be able to respond quickly enough to cope with any changes in load conditions that occur during a trip. The quick response of the VCR control system is necessary not only to assure smooth operation of the vehicle during the change in compression ratio takes place but also to protect the engine. For example, in a four-cylinder engine, the response and execution time of the VCR control system will have to be as short as that spent in one half rotation of the driveshaft to prevent knocking in the next combustion phase in the same cylinder.

It is probably true that the super-fast responding VCR control system such as described above should generally be able to operate the engine with a higher compression ratio than the compression ratio in a slow-responding VCR control system because the potential damage from operating the engine with a higher-than-ordinary compression ratio is much smaller than operating the engine with a slow responding VCR system, and/or that the VCR control system does not have to keep changing the compression ratio continuously as long as the compression ratio is kept in a permissible range and the system is ready to respond to any sudden large changes in all load conditions.

Our review of reports available in the public domain suggests that, in general, the hydraulic actuator tends to have a leak problem when operated under high pressure, and the mechanical actuator powered by the electric motor tends to have a longer response and execution time than desired.

OBJECTS OF THE INVENTION

An object of this invention is the provision of a VCR actuation subsystem that is able to change the compression ratio on a real time basis without an unwanted time lag.

An object of this invention is the provision of a VCR actuation subsystem that is able to reduce the compression ratio fast enough not to require advancing the ignition timing when knock is detected.

An object of this invention is the provision of a VCR actuation subsystem that does not keep changing the compression ratio continuously, but changes the compression ratio as the necessity of doing so occurs: the VCR control system continuously keeps measuring the load conditions and the compression ratio, and changes the compression ratio when the difference between the desired compression ratio (due to the measured current load conditions) and the current compression ratio becomes greater than a preset value.

An object of this invention is the provision of a VCR actuation subsystem that is able to maximize the compression ratio under all load conditions by changing the compression ratio continuously.

An object of this invention is the provision of a VCR actuation subsystem that is sturdy enough to endure long time continuous use of the VCR control system.

SUMMARY OF THE INVENTION

An actuation subsystem of a variable compression ratio control system includes a drive means, a connecting means, and an actuator means. The drive means of the preferred embodiment of this invention includes a pair of generally identical clutch assemblies. The clutch assembly includes a clutch driver plate assembly and a clutch driven plate assembly. The clutch driver plate assemblies are rigidly mounted on the power shaft of an engine and the clutch driven plate assemblies are rotatably and longitudinally slidably mounted on the power shaft in such a manner that the clutch driven plate assemblies are placed next to each other, wherein the power shaft may be a driveshaft or a crankshaft.

The clutch driver plate assembly includes a solenoid and a driver plate. The clutch driven plate assembly includes a cylindrical core, a clutch driven plate, a back plate, a spring, and a pulley tire longitudinally slidably mounted on the core's outer cylindrical wall. The spring holds the clutch driven plate away from the paired clutch driver plate assembly and pushes the clutch driven plate assembly toward the other clutch driven plate assembly, causing their back plates pressed against each other to prevent the drive gear shaft described blow from rotating in either direction when the clutch assemblies are not activated. The connecting means includes an idler shaft, a drive gear shaft, a pulley mounted on the idler shaft, a pulley mounted on the drive gear shaft, a spur gear set mounted on the idler shaft and the drive gear shaft. The first clutch driven plate assembly and the pulley on the idler shaft are rotatably connected by a belt, and second clutch driven plate assembly and the pulley on the drive gear shaft are rotatably connected by a belt.

The actuator means of the preferred embodiment of the present invention is a plurality of jackscrew assemblies. The jackscrew assembly includes a jackscrew comprising a worm gear mounted on the drive gear shaft, a thimble with a worm gear, a spindle and a base plate, an upper plate, and a hexahedron-shaped arm holder with a hexahedron-shaped opening. The top end of the spindle is affixed to the bottom of the arm holder. The arm holder is pivotally and laterally slidably connected to an arm member (or a control lever) of the VCR control system.

BRIEF DESCRIPTION OF THE DRAWINGS

The above description and other objects and advantages of this invention will become more clearly understood from the following description when considered with the accompanying drawings. It should be understood that the drawings are for purposes of illustration only and not by way of limitation of the invention. In the drawings, like reference characters refer to the same parts in the several views.

DETAILED DESCRIPTION OF THE INVENTION

Figure 1:
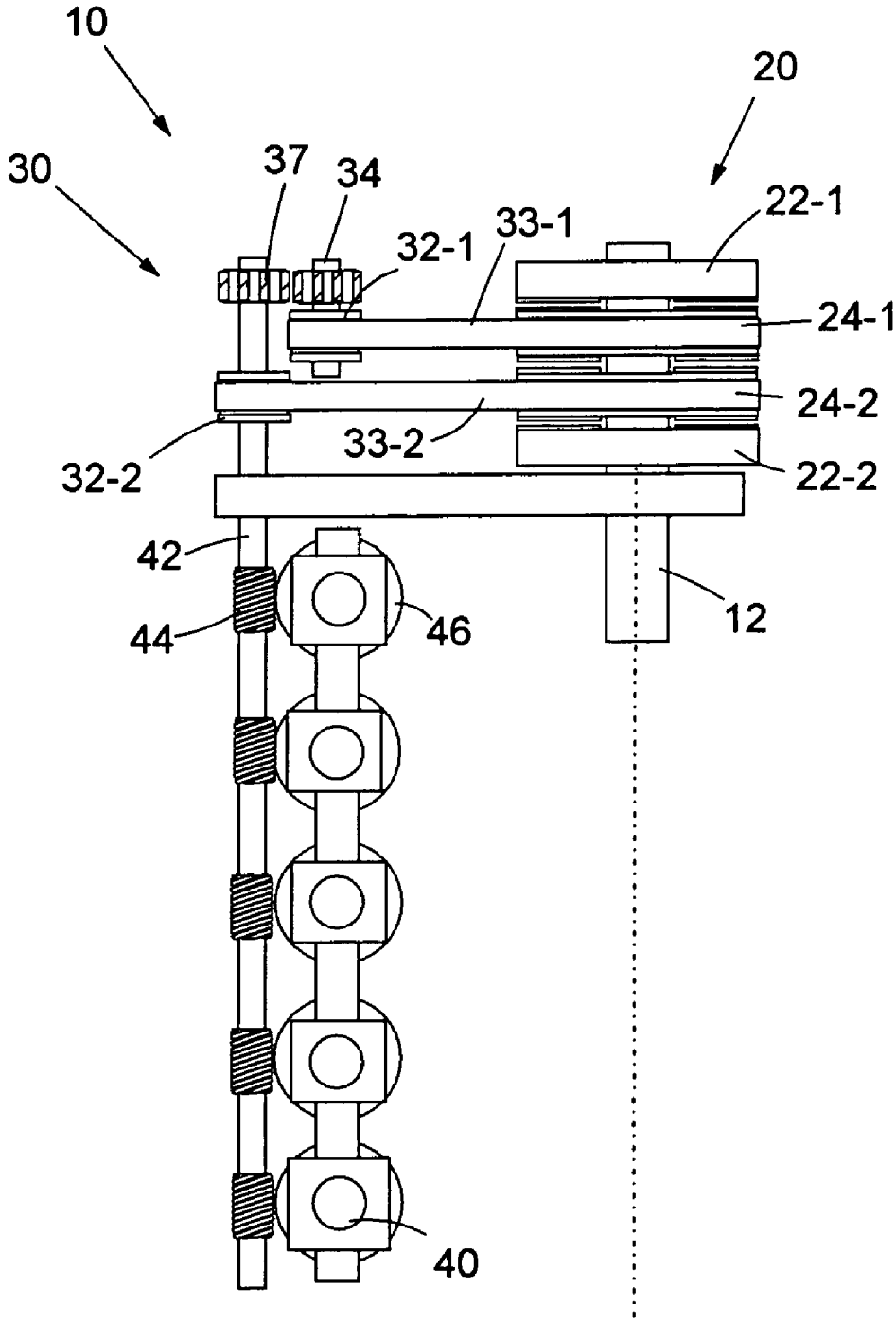
FIG. 1 is a top elevational view of a VCR actuation subsystem of the preferred embodiment.

As shown in FIG. 1, an actuation subsystem 10 of a variable compression ratio control system includes a drive means 20, a connecting means 30, and an actuator means 40. The drive means 20 includes generally identical first and second clutch assemblies. The clutch assembly comprises a clutch driver plate assembly 22-1 and a clutch driven plate assembly 24-1. The clutch driver plate assembly 22-1 is rigidly mounted on the power shaft 12 of an engine and the clutch driven plate assembly 24-1 is rotatably and longitudinally slidably mounted in a groove 16 (see FIG. 2) on the power shaft in such a manner that the back surfaces of the clutch driven plate assemblies 24-1 and 24-2 are facing each other, wherein the power shaft may be a driveshaft or a crankshaft. The clutch drive plate assembly 22-2 is generally identical to the clutch drive plate assembly 22-1. The clutch driven plate assembly 24-2 is generally identical to the clutch driven plate assembly 24-1.

Figure 2:
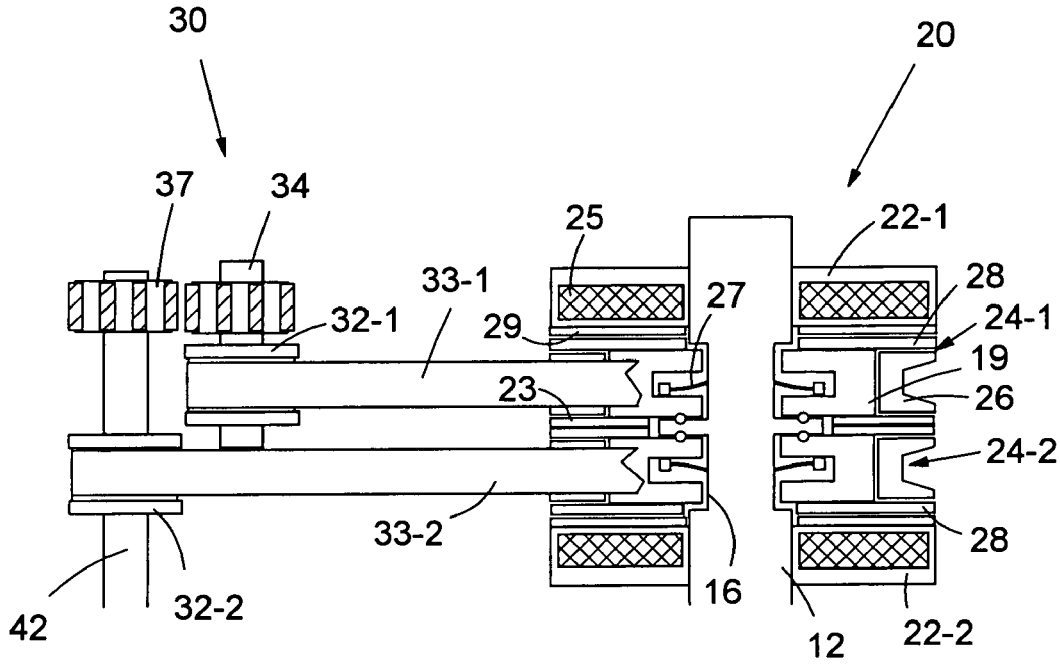
FIG. 2 is an expanded cross-sectional view in partial elevational view of the drive mechanism of the VCR actuation subsystem.

As shown in FIG. 2, the clutch driver plate assembly 22-1 includes a solenoid 25 and a clutch driver plate 29. The clutch driven plate assembly 24-1 includes a core 19 with a cylindrical outer wall, a clutch driven plate 28 affixed to the sidewall of the core 19 facing the clutch driver plate 29 of the paired clutch driver plate assembly 22-1, a back plate 23 affixed to the sidewall of the core 19 facing the back plate 23 of the other clutch driven plate assembly 24-2, a spring 27, and a pulley tire 26 longitudinally slidably mounted on the core's 19's cylindrical outer wall. The spring 27 holds the clutch driven plate assembly 24-1 away from the clutch driver plate assembly 22-1, and pushes the clutch driven plate assembly 24-1 toward the other clutch driven plate assembly 24-2 so that their back plates 23 are always pressed against each other to prevent the drive gear shaft 42 described below from rotating in either direction when neither of the clutch assemblies is activated.

As shown in FIG. 1, the connecting means includes an idler shaft 34, a drive gear shaft 42, a pulley 32-1 mounted on the idler shaft 34, a pulley 32-2 mounted on the drive gear shaft 42, a spur gear set 37 mounted on the idler shaft 34 and the drive gear shaft 42. Note that the expression "mounted on a shaft" without any adverb such as rotatably or longitudinally slidably implies "rigidly mounted on a shaft" as usually done in mounting gears etc. on a shaft. The power shaft, the drive gear shaft, and the idler shaft are all in parallel to one another. The first clutch driven plate assembly 24-1 and the pulley 32-1 on the idler shaft 34 are rotatably connected by a belt 33-1; and the second clutch driven plate assembly 24-2 and the pulley 32-2 on the drive gear shaft 42 are rotatably connected by a belt 33-2. The gear ratio of the gears of the spur gear set 34 is 1 to 1; the diameter of the pulley 24-1 is larger than that of the pulley 32-1; and similarly, the diameter of the pulley 24-2 is larger than that of the pulley 32-2. The ratio of diameters of the pulleys 24-2 and 32-2 equals the ratio of diameters of the pulleys 24-1 and 32-1.

Figure 3:
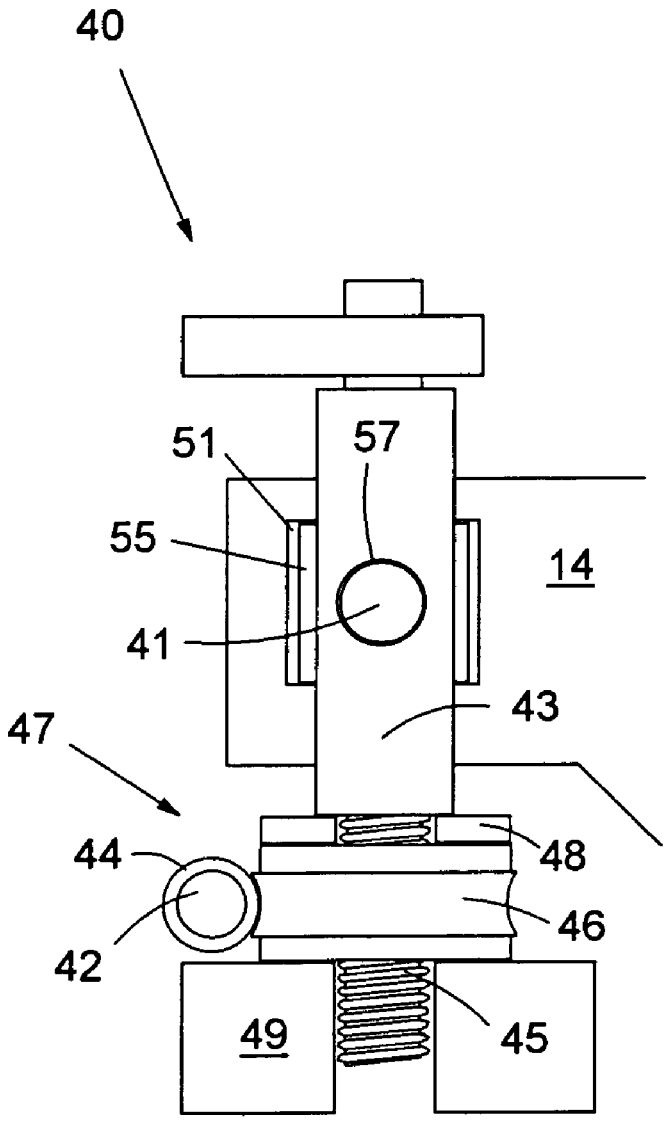
FIG. 3 is a rear view in partial cross-sectional view of the actuator means of the preferred embodiment of the present invention.
Figure 4:
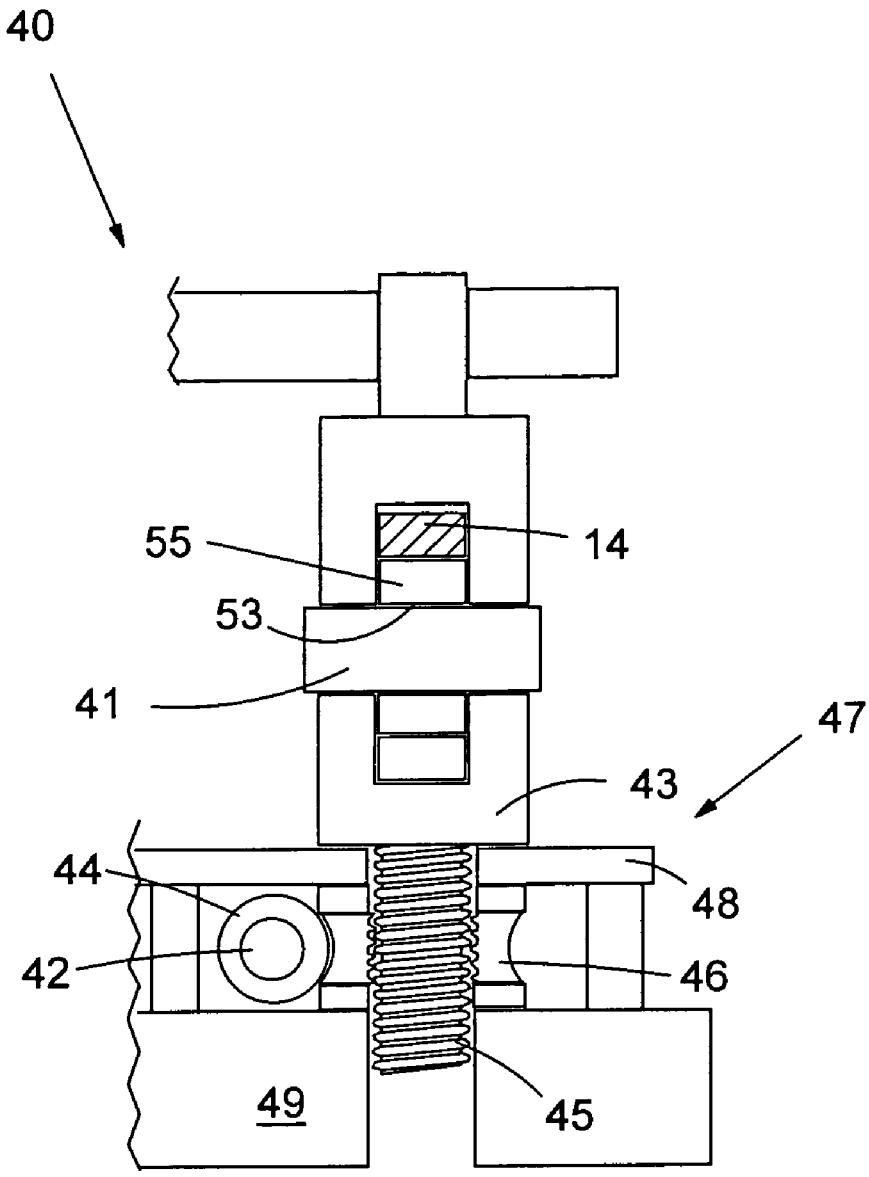
FIG. 4 is cross-sectional view of the actuator means of the preferred embodiment of the present invention.

As shown in FIGS. 3 and 4, the actuator means 40 of the preferred embodiment of the present invention is a plurality of jackscrew assemblies. The jackscrew assembly includes a jackscrew 47 comprising a thimble with a worm gear 46, a worm gear 44 mounted on the drive gear shaft 42 and meshes with the worm gear 46, a spindle 45 and a base plate 49, an upper plate 48, and a hexahedron-shaped arm holder 43. The spindle 45 is affixed to the bottom of the arm holder 43. The worm gear 46 is disposed between the base plate 49 and the upper plate 48 of the worm gear housing. A thrust bearing may be placed between the top surface of the worm gear 46 and the upper plate 48, and another thrust bearing may be placed between the bottom surface of the worm gear 46 and the base plate 49. The jackscrew assembly shown in FIG. 3 is generally the same as that shown in U.S. Pat. No. 7,174,865 B2 by the inventor of the present invention. A self contained jackscrew including a worm gear set and thrust roller bearings named Joyce Machine Screw Jack is available in the market. A jackscrew such as the Joyce Machine Screw Jack may be used as a building block of the actuation subsystem.

The hexahedron-shaped arm holder 43 has front and rear walls, top and bottom walls, and a hollow hexahedron-shaped inner space with open-ended two sides. The hollow inner space of the arm holder 43 slidably receives the arm member (or a control lever) 14 used in lifting up/down the crankshaft in such a manner that the front and rear walls of the arm holder 43 generally slidably covers the square window 51 of the arm member, and holds the arm member 14 inside the hexahedron-shaped inner space 53. The arm holder 43 is pivotally connected to a hexahedron-shaped metal piece 55 by a pin 41 wherein the hexahedron metal piece 55 is slidably received by a square window 51 of the arm member 14.

Under the normal condition, neither of the clutch assemblies is activated. In operation, only one of the clutch assemblies is activated at a time. When the first clutch assembly is activated, the arm member 14 is lifted/lowered (or pushed/pulled) in one direction, and when the second clutch assembly is activated the arm member 14 is lifted/lowered (or pushed/pulled) in the other direction.

Figure 5:
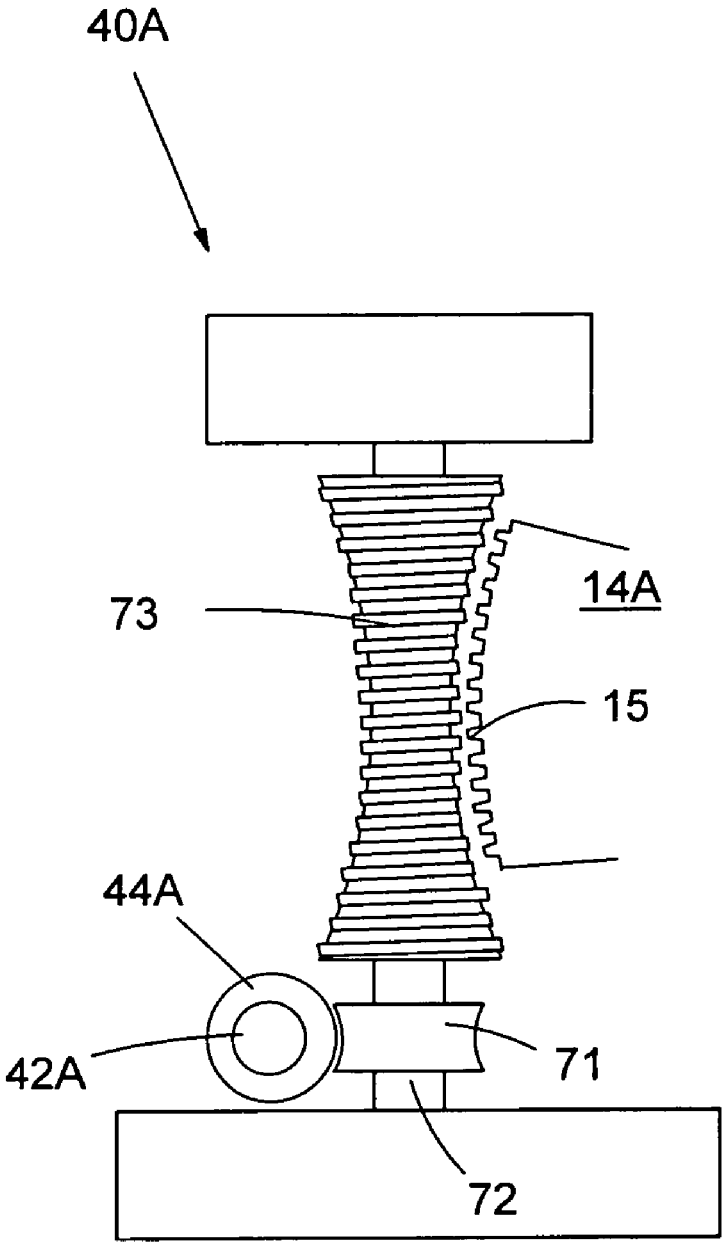
FIG. 5 is a rear elevational view in partial cross-sectional view of the actuator means of an alternative embodiment that uses a plurality of worm gear assemblies.

As shown in FIG. 5, an actuator means 40A of an alternative embodiment includes a plurality of worm gear assemblies each of which includes worm gears 44A and 71 wherein the worm gear 44A is mounted on the drive gear shaft 42A, and the worm gear 71 is mounted on the worm gear assembly shaft 72. A variable-diameter worm gear 73 that has an arc-shaped concave cross section is mounted on the gear assembly shaft 72. The teeth of the worm gear 73 mesh with the gear teeth 15 that are disposed on an arc-shaped convex surface of the arm member 14A of a VCR control system. The worm gear assemblies may be disposed not only vertically but also horizontally (see FIG. 6). The worm gear assembly shown in FIG. 5 is generally the same as that shown in U.S. Pat. Nos. 7,007,640 and 7,174,865 by the inventor of the present invention.

Figure 6:
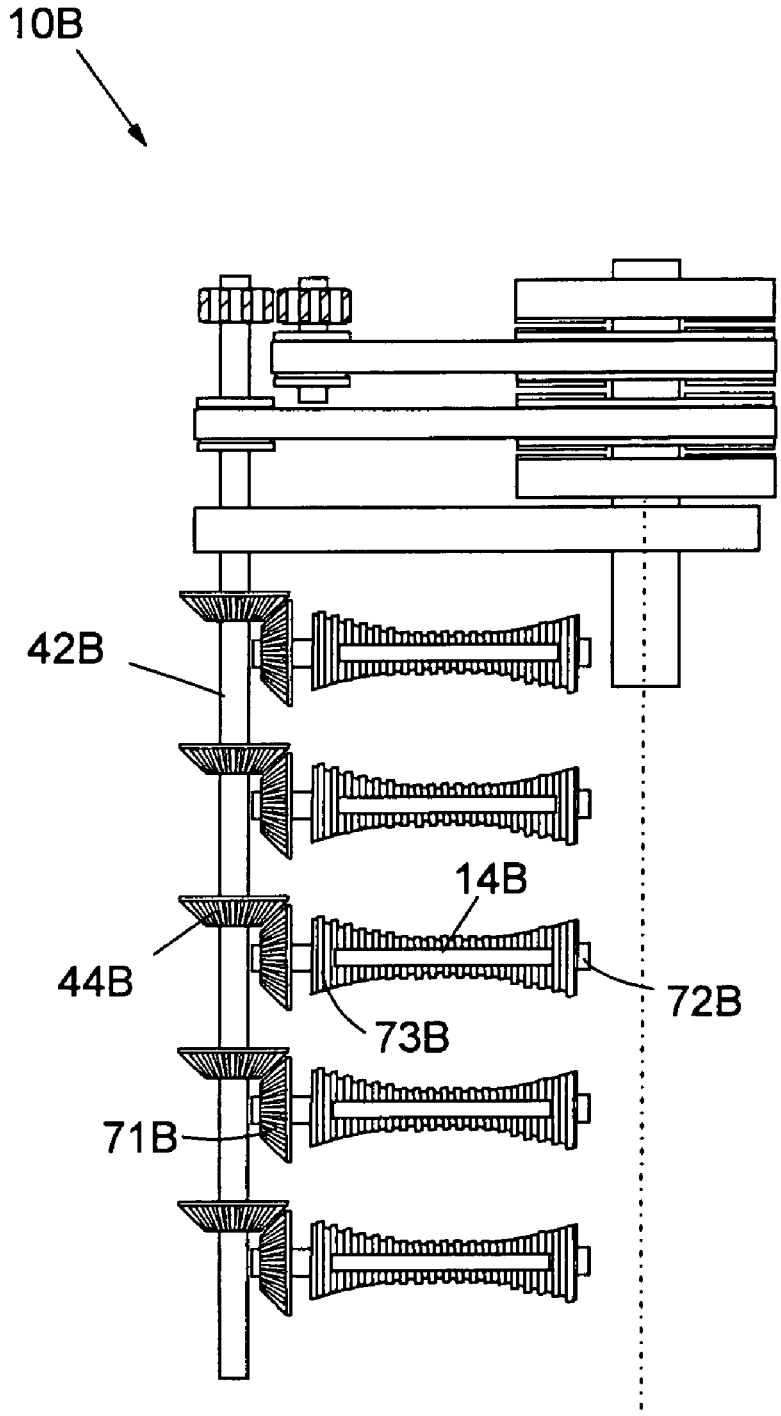
FIG. 6 is a top elevational view of the VCR actuation subsystem of an alternative embodiment that uses a plurality of worm gear assemblies.

As shown in FIG. 6, another alternative embodiment 10B of the present invention includes a plurality of actuator means having bevel gears 44B mounted on the drive gear shaft 42B and bevel gears 71B mounted on the worm gear assembly shaft 72B disposed horizontally.

Figure 7:
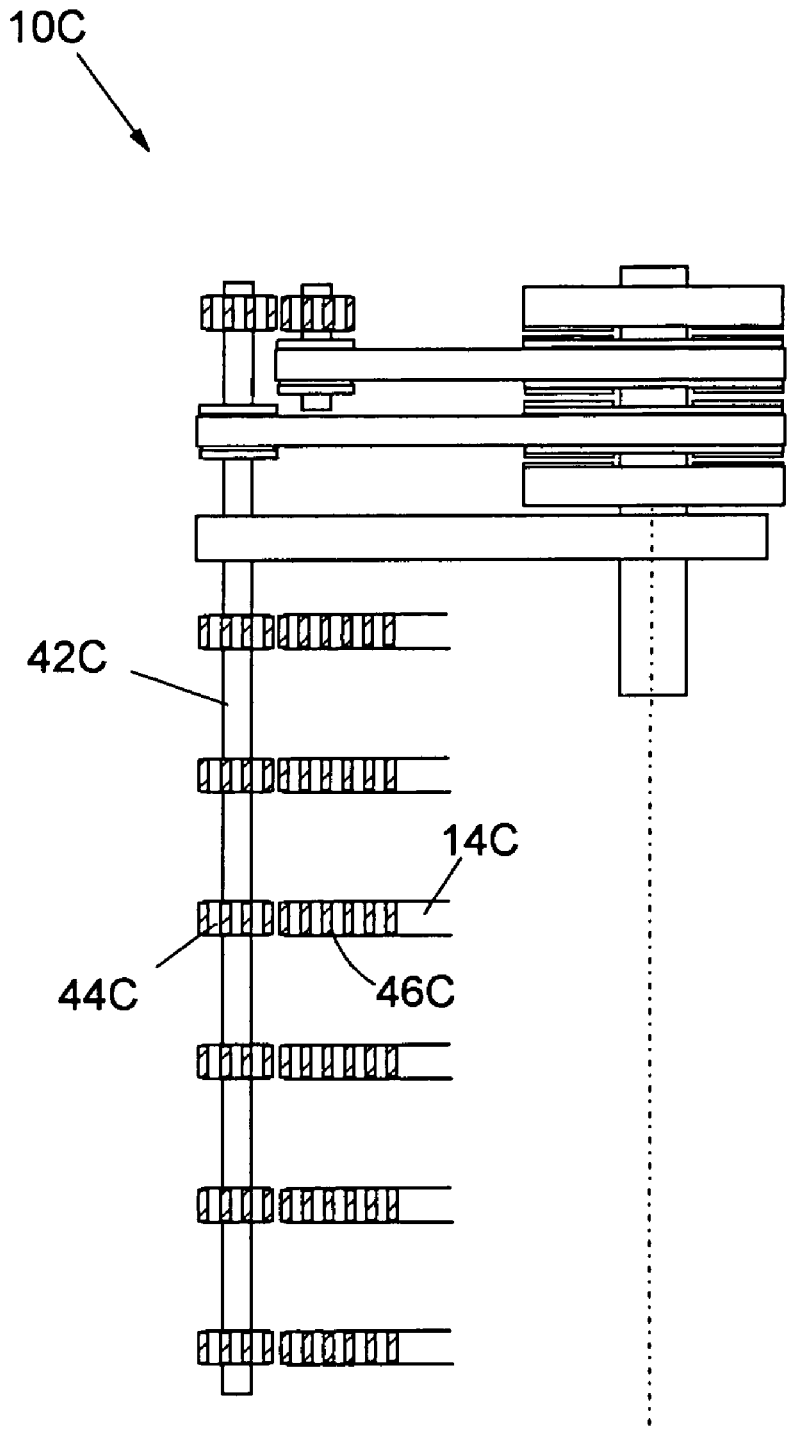
FIG. 7 is a top elevational view in partial cross sectional view of the VCR actuation subsystem of another alternative embodiment that uses at least one spur gear.

As shown in FIG. 7, another alternative embodiment 10C of the present invention includes at least one spur gear 44C that is mounted on the drive gear shaft 42C wherein the spur gear 44C meshes a partial spur gear 46C mounted on an arm member 14C of the variable compression ratio control system.

Figure 8:
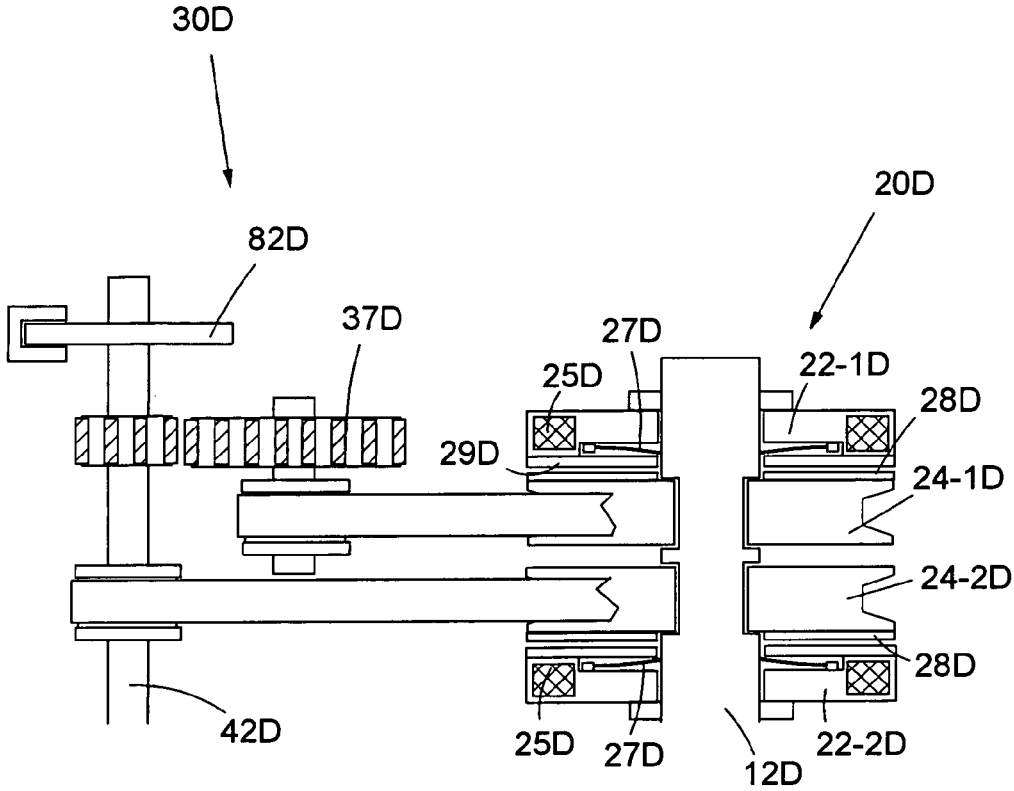
FIG. 8 is an expanded cross-sectional view in partial elevational view of an alternative embodiment of the drive mechanism of the VCR actuation subsystem.

The drive means 20D of an alternative embodiment shown in FIG. 8 includes generally identical first and second clutch assemblies. The first clutch assemblies comprises a clutch driver plate assembly 22-1D and a clutch driven plate assembly 24-1D, and the second clutch assembly comprises a clutch driver plate assembly 22-2D and a clutch driven plate assembly 24-2D. The clutch driver plate assemblies 22-1D and 22-2D are longitudinally slidably mounted on a power shaft 12D of an engine and the clutch driven plate assemblies 24-1D and 24-2D are rotatably mounted on the power shaft wherein the power shaft may be a driveshaft or a crankshaft. The clutch driver plate assembly 22-1D (or 22-2D) includes a solenoid 25D, a driver plate 29D, a spring 27D that holds the driver plate away from the paired clutch driven plate assembly 24-1 (or 24-2). The clutch driven plate assembly 24-1D (or 24-2D) includes a clutch driven plate 28D and a pulley tire affixed to its outer cylindrical wall. The connecting means 30D includes a brake 82D that prevents the drive gear shaft 42D from rotating when neither of the clutch assemblies is activated, and the gear sets 37D with a gear ratio not having to be 1 to 1.

Figure 9:
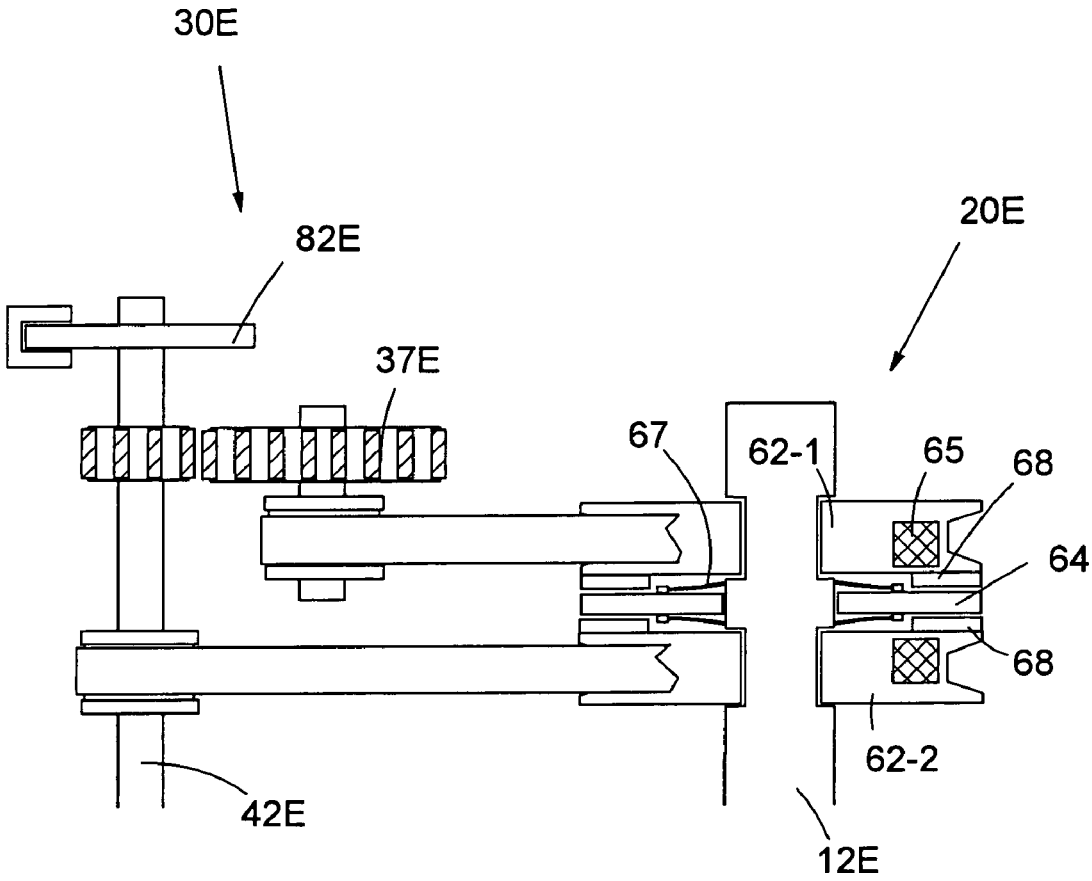
FIG. 9 is an expanded cross-sectional view in partial elevational view of another alternative embodiment of the drive mechanism of the VCR actuation subsystem.

The drive means 20E of another alternative embodiment shown in FIG. 9 includes a pair of generally identical clutch driver plate assemblies 62-1 and 62-2 each of which including a clutch driver plate and a pulley tire mounted on its cylindrical outer wall, rotatably mounted on the power shaft 12E; and the clutch driven plate assembly 64 that includes a clutch driven plate and a pair of springs 67, longitudinally slidably mounted on the power shaft 12E. The clutch driver plate assemblies 62-1 is rotatably connected to the pulley 32-1E mounted on the idler shaft by a belt 33-1E, and the other clutch driver plate assembly 62-2 is rotatably connected to the pulley 32-2E mounted on the drive gear shaft by a belt 33-2E. The connecting means 30E includes a brake 82E that prevents the drive gear shaft 42E from rotating, and the gear sets 37E with a gear ratio not having to be 1 to 1.

Another alternative embodiment of the drive means 20G includes generally identical drive means to that of the embodiment 20D except that the pair of the clutch assemblies are mounted on the drive gear shaft 42G.

Another alternative embodiment of the drive means 20H includes generally identical drive means 20E except that the pair of the clutch driver plate assemblies and the clutch driven plate assembly are mounted on the drive gear shaft 42H.

The invention having been described in detail in accordance with the requirements of the U.S. Patent Statutes, various other changes and modifications will suggest themselves to those skilled in this art. For example, the pulleys and belts may be replaced by gears, or the pulley ratios may be different from that described above, or the brake mounted on the drive gear shaft in some of the alternative embodiment may not be necessary. It is intended that the above and other such changes and modifications shall fall within the spirit and scope of the invention defined in the appended claims.

I claim:

1. An actuation subsystem of a variable compression ratio control system including a drive means, a connecting means, an actuator means wherein said drive means including first and second clutch assemblies, said connecting means rotatably connects said drive means and said actuator means, said clutch assembly including a clutch driver plate assembly and a clutch driven plate assembly, said clutch driver plate assembly including a clutch driver plate and a solenoid, said clutch driven plate assembly includes a clutch driven plate, said clutch driver plate assemblies being mounted on a power shaft of an engine, and said clutch driven plate assembly being rotatably and longitudinally slidably mounted on said power shaft wherein said power shaft is either a driveshaft or a crankshaft.

2. An actuation subsystem of a variable compression ratio control system as defined in claim 1 wherein said clutch driver plate assemblies being longitudinally slidably mounted on a power shaft of an engine, and said clutch driven plate assembly being rotatably mounted on said power shaft of an engine wherein said power shaft is either a driveshaft or a crankshaft.

3. An actuation subsystem of a variable compression ratio control system as defined in claim 1 wherein said connecting means including a drive gear shaft, said clutch driver plate assemblies being mounted on said drive gear shaft, and said clutch driven plate assembly being rotatably and longitudinally slidably mounted on said drive gear shaft wherein said drive gear shaft is neither a driveshaft nor a crankshaft of an engine.

4. An actuation subsystem of a variable compression ratio control system as defined in claim 1 wherein said connecting means including a drive gear shaft, said clutch driver plate assemblies being longitudinally slidably mounted on said drive gear shaft, and said clutch driven plate assembly being rotatably mounted on said drive gear shaft wherein said drive gear shaft is neither a driveshaft nor a crankshaft of an engine.

5. An actuation subsystem of a variable compression ratio control system as defined in claim 1 wherein said connecting means including an idler shaft, a drive gear shaft, a pulley mounted on said idler shaft, a pulley mounted on said drive gear shaft, a spur gear mounted on said idler shaft, and a spur gear mounted on said drive gear shaft wherein said clutch driven plate assembly of said first clutch assembly and said pulley on said idler shaft being rotatably connected by a belt, said clutch driven plate assembly of said second clutch assembly and said pulley on said drive gear shaft being rotatably connected by a belt, and said spur gear on said idler shaft meshes with said spur gear on said drive gear shaft.

6. An actuation subsystem of a variable compression ratio control system as defined in claim 1 wherein said connecting means including a drive gear shaft, said actuator means including a plurality of jackscrew assemblies, said jackscrew assembly including a jackscrew that comprises a thimble with a worm gear, a worm gear mounted on said drive gear shaft, a spindle of said jackscrew assembly, and an arm holder wherein said worm gear of said thimble meshes with said worm gear mounted on said drive gear shaft, said variable compression ratio control system having an arm member, and said arm holder and said arm member are pivotally and slidably connected to each other.

7. An actuation subsystem of a variable compression ratio control system as defined in claim 1 wherein said connecting means including a drive gear shaft, said actuator means including a plurality of worm gear assemblies, wherein said worm gear assembly including a worm gear assembly shaft, a worm gear mounted on said worm gear assembly shaft, and a worm gear with a variable diameter having an arc-shaped cross section mounted on said worm gear assembly shaft, and said worm gear mounted on said worm gear assembly shaft meshes with said worm gear mounted on said drive gear shaft.

8. An actuation subsystem of a variable compression ratio control system as defined in claim 1 wherein said connecting means including a drive gear shaft, said actuator means including a plurality of worm gear assemblies, wherein said worm gear assembly including a bevel gear mounted on a worm gear assembly shaft, a bevel gear mounted on said drive gear shaft, and a worm gear with a variable diameter having an arc-shaped cross section being mounted on said worm gear assembly shaft, and said bevel gear mounted on said drive gear shaft and said bevel gear of said worm gear assembly mesh together.

9. An actuation subsystem of a variable compression ratio control system as defined in claim 1 wherein said connecting means including a drive gear shaft, said actuator means including at least one spur gear mounted on said drive gear shaft.

10. An actuation subsystem of a variable compression ratio control system as defined in claim 1 wherein said first and second clutch driver plate assemblies will not be activated simultaneously.

11. An actuation subsystem of a variable compression ratio control system including a drive means, a connecting means, an actuator means wherein said drive means including first and second clutch driver plate assemblies and a clutch driven plate assembly, said clutch driver plate assembly including a clutch driver plate, a solenoid and a pulley tire, said clutch driven plate assembly includes a clutch driven plate, said clutch driver plate assemblies being rotatably mounted on a power shaft of an engine, said clutch driver plate assembly having a cylindrical outer wall, said pulley tire mounted on said cylindrical outer wall, and said clutch driven plate assembly being longitudinally slidably mounted on said power shaft of an engine wherein said power shaft is either a driveshaft or a crankshaft.

12. An actuation subsystem of a variable compression ratio control system as defined in claim 11 wherein said clutch driver plate assemblies being rotatably and longitudinally slidably mounted on a power shaft of an engine, said clutch driver plate assembly having a cylindrical outer wall, said pulley tire mounted on said cylindrical outer wall, and said clutch driven plate assembly being mounted on said power shaft of an engine wherein said power shaft is either a driveshaft or a crankshaft.

13. An actuation subsystem of a variable compression ratio control system as defined in claim 11 wherein said connecting means including a drive gear shaft said clutch driver plate assemblies being rotatably mounted on said drive gear shaft, said clutch driver plate assembly having cylindrical outer wall, said pulley tire mounted on cylindrical outer wall, and said clutch driven plate assembly being slidably mounted on said drive gear shaft.

14. An actuation subsystem of a variable compression ratio control system as defined in claim 11 wherein said connecting means including an idler shaft, a drive gear shaft, a pulley mounted on said idler shaft, a pulley mounted on said drive gear shaft, a spur gear mounted on said idler shaft, and a spur gear mounted on said drive gear shaft wherein said first clutch driver plate assembly and said pulley on said idler shaft being rotatably connected by a belt, said second clutch driver plate assembly and said pulley on said drive gear shaft being rotatably connected by a belt, and said spur gear on said idler shaft meshes with said spur gear on said drive gear shaft.

15. An actuation subsystem of a variable compression ratio control system as defined in claim 11 wherein said connecting means including a drive gear shaft, said actuator means including a plurality of jackscrew assemblies, said jackscrew assembly including a jackscrew that comprises a thimble with a worm gear, a worm gear mounted on said drive gear shaft, a spindle of said jackscrew assembly, and an arm holder wherein said worm gear of said thimble meshes with said worm gear mounted on said drive gear shaft, said variable compression ratio control system having an arm member, and said arm holder and said arm member are pivotally and slidably connected to each other.

16. An actuation subsystem of a variable compression ratio control system as defined in claim 11 wherein said connecting means including a drive gear shaft, said actuator means including a plurality of worm gear assemblies, wherein said worm gear assembly including a worm gear assembly shaft, a worm gear mounted on said worm gear assembly shaft, and a worm gear with a variable diameter having an arc-shaped cross section mounted on said worm gear assembly shaft, and said worm gear mounted on said worm gear assembly shaft meshes with said worm gear mounted on said drive gear shaft.

17. An actuation subsystem of a variable compression ratio control system as defined in claim 11 wherein said connecting means including a drive gear shaft, said actuator means including a plurality of worm gear assemblies, wherein said worm gear assembly including a bevel gear mounted on a worm gear assembly shaft, a bevel gear mounted on said drive gear shaft, and a worm gear with a variable diameter having an arc-shaped cross section being mounted on said worm gear assembly shaft, and said bevel gear mounted on said drive gear shaft and said bevel gear of said worm gear assembly mesh together.

18. An actuation subsystem of a variable compression ratio control system as defined in claim 11 wherein said connecting means including a drive gear shaft, said actuator means including a plurality of spur gears mounted on said drive gear shaft.

19. An actuation subsystem of a variable compression ratio control system as defined in claim 11 wherein said first and second clutch driver plate assemblies will not be activated simultaneously.

20. An actuation subsystem of a variable compression ratio control system including a drive means, a connecting means, an actuator means wherein said drive means including first and second clutch assemblies, said connecting means including an idler shaft, a drive gear shaft, a pulley mounted on said idler shaft, a pulley mounted on said drive gear shaft, a spur gear mounted on said idler shaft, and a spur gear mounted on said drive gear shaft, and said first and second clutch assemblies rotatably connected to said actuator means.

21. An actuation subsystem of a variable compression ratio control system as defined in claim 20 wherein said actuator means including a plurality of jackscrew assemblies, said jackscrew assembly including a jackscrew that comprises a thimble with a worm gear, a worm gear mounted on said drive gear shaft, a spindle of said jackscrew assembly, and an arm holder wherein said worm gear of said thimble meshes with said worm gear mounted on said drive gear shaft, said variable compression ratio control system having an arm member, and said arm holder and said arm member are pivotally and slidably connected to each other.

22. An actuation subsystem of a variable compression ratio control system as defined in claim 20 wherein said actuator means including a plurality of worm gear assemblies, wherein said worm gear assembly including a worm gear assembly shaft, a worm gear mounted on said worm gear assembly shaft, and a worm gear with a variable diameter having an arc-shaped cross section mounted on said worm gear assembly shaft, and said worm gear mounted on said worm gear assembly shaft meshes with said worm gear mounted on said drive gear shaft.

23. An actuation subsystem of a variable compression ratio control system as defined in claim 20 wherein said actuator means including a plurality of worm gear assemblies, wherein said worm gear assembly including a bevel gear mounted on a worm gear assembly shaft, a bevel gear mounted on said drive gear shaft, and a worm gear with a variable diameter having an arc-shaped cross section being mounted on said worm gear assembly shaft, and said bevel gear mounted on said drive gear shaft and said bevel gear of said worm gear assembly mesh together.

24. An actuation subsystem of a variable compression ratio control system as defined in claim 20 wherein said actuator means including at least one spur gear mounted on said drive gear shaft.

25. An actuation subsystem of a variable compression ratio control system as defined in claim 20 wherein said first and second clutch driver plate assemblies will not be activated simultaneously.

* * * * *